United States Patent [19]

Rand

[11] Patent Number: 4,506,819

[45] Date of Patent: Mar. 26, 1985

[54] STAPLE SUPPLY INDICATOR

[76] Inventor: Burt E. Rand, 169 Coburn Woods, Nashua, N.H. 03063

[21] Appl. No.: 533,605

[22] Filed: Sep. 19, 1983

[51] Int. Cl.[3] ..... B25C 5/02; B25C 5/06; B25F 7/00

[52] U.S. Cl. ..... 227/120; 227/127; 227/128; 227/156

[58] Field of Search ..... 227/120, 127, 128, 136, 227/156

[56] References Cited

U.S. PATENT DOCUMENTS

| | | | |
|---|---|---|---|
| 2,227,826 | 1/1941 | Drypolcher | 227/127 X |
| 2,341,530 | 2/1944 | Crosby | 227/128 |
| 2,973,519 | 3/1961 | Jopp | 227/128 |

*Primary Examiner*—Paul A. Bell
*Assistant Examiner*—Taylor J. Ross
*Attorney, Agent, or Firm*—Pearson & Pearson

[57] ABSTRACT

A stapler for attaching a plurality of sheets of paper, or the like, to each other comprises an elongated anvil member, forming a base, an elongated staple magazine member and an elongated driver member, forming a cover, all pivotally connected, at one end, to each other, there being a detent on the magazine member, a longitudinally slidable latch on the cover member lockable under the detent and the usual longitudinally movable, spring urged staple follower. The staple follower moves the latch to release position, near the end of its path, to indicate that the supply of staples is nearly exhausted.

8 Claims, 9 Drawing Figures

*Fig.1.*
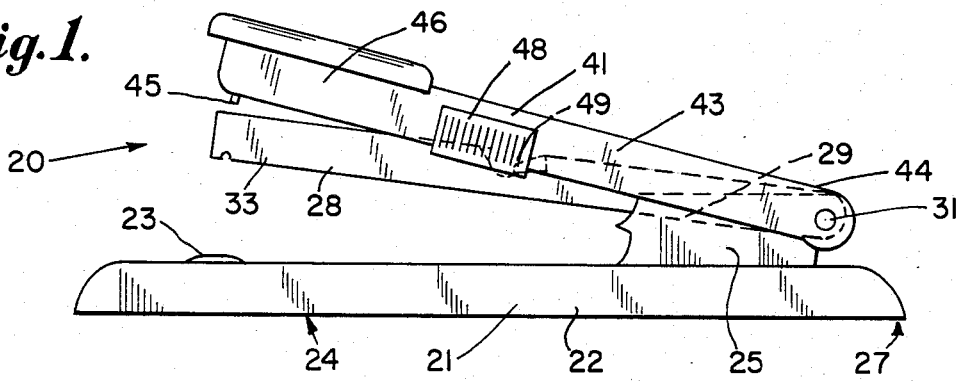
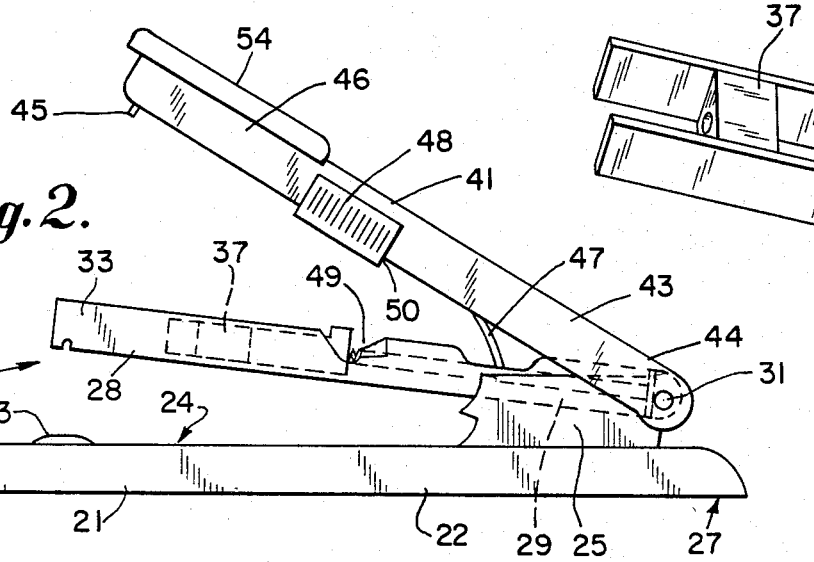
*Fig.2.*
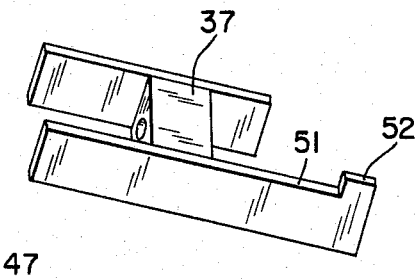
*Fig.4.*
*Fig.3.*
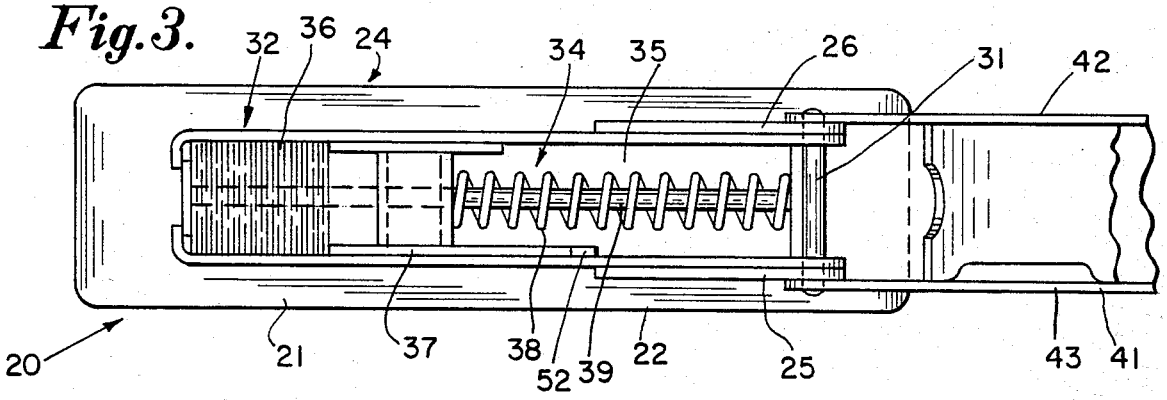
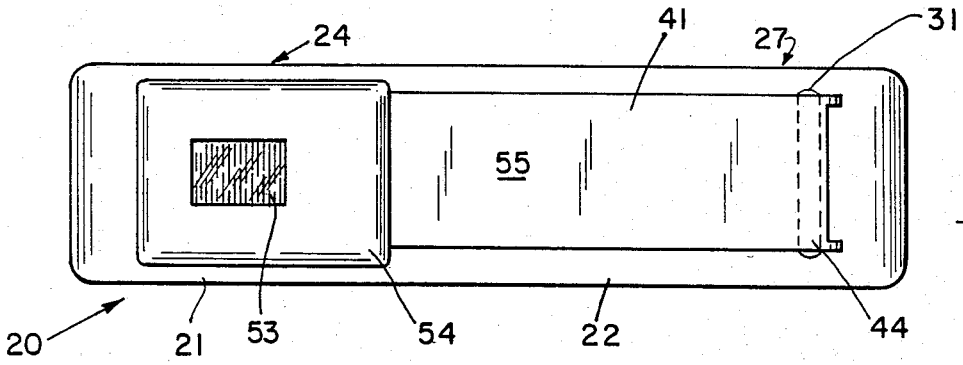
*Fig.5.*

STAPLE SUPPLY INDICATOR

BACKGROUND OF THE INVENTION

The present invention relates to an improvement in staplers for commercial and residential use. More specifically, the stapler of the present invention will enable the user to physically be alerted when the stapler is empty and needs refilling.

One of the disadvantages and drawbacks of the standard stapler involves determining when the stapler is empty before the staples actually run out.

During a large stapling job, the user is oftentimes surprised to discover that the stapler needs loading. Usually, this becomes evident after several papers have been stapled unsuccessfully. It has long been desirable to remedy this situation and provide a warning to the user that the stapler is empty. There has been an attempt to solve this problem in the past as evidenced by a British stapler, discovered by the applicant, in which a small window is supplied in the side of the staple magazine in which the end staples may be viewed. However, the user must continually watch the side window lest the staples run out unnoticed. This constant inspection alleviates the problem of staples running out without warning, but creates considerable problems in the efficiency of operation and convenience for the operator.

Another solution, proposed in the prior art, quite similar to the above is exemplified by U.S. Pat. No. 2,341,530 to Crosby of Feb. 15, 1944. The Crosby Patent shows a staple tacker which incorporates an indicator means to determine the exhaustion of staples within a magazine while the stapler is closed. This is also accomplished by the use of a small window or perforation in the side of the staple magazine. A red indicator or target is painted on the inner staple follower such that as the follower advances and one or more staples are left, the user will view the red indicator and realize that loading is necessary. Such a perforation is not only small, but relatively difficult to observe during the stapling process. Thus, the user must stop between each stapling action to determine whether the red indicator is showing. Constant monitoring of a side window would prove to be highly inefficient when stapling a series of multiple papers. Consequently, the user may choose to ignore an indicator of this type and simply wait for staples to be exhausted.

Another solution, similar to the Crosby Patent is shown in U.S. Pat. No. 2,973,519 to Jopp of Mar. 7, 1961. The Jopp invention is concerned with non-jamming staplers and provides a means for seeing when only a few staples remain. In this regard, apertures are provided in an apron 33 and in the staple magazine. Normally, the user sees the silver luster of the staples until diminishing staples cause the apertures to overlap whereby the user sees the black color of the magazine which will indicate that loading is required. Again, the apertures are so small and poorly located on the side that the user must take special care not to miss the warning.

In the "Bostitch" type stapler, the driver member is urged upwardly from the magazine member when a longitudinally slidable latch on the driver member is slid rearwardly out from under a sidewise projecting detent on the magazine member and located in front of the latch.

In this invention the Bostitch type stapler is provided with a similar detent but located in rear of the latch so that the latch releases by forward sliding on the magazine member. The conventional inverted U shaped staple follower has one of its legs further elongated and provided with an upstanding integral lug which strikes the latch to release it forwardly when the follower nears the end of its path. This not only releases the driver member from the magazine member to indicate exhaustion of staples, but the conventional leaf spring snaps the driver member upwardly to visually reveal the empty magazine.

If the Bostitch Type Stapler still includes the rearward sliding latch release, a flexible strand may extend from the staple follower back around the pivot pin of the stapler and thence forwardly to the latch so that further advance of the follower at the end of its path will pull the latch rearwardly toward the pivot pin to snap up the driver member and indicate refill.

The well known "Swingline" type stapler is constructed in a manner similar to the "Bostitch" stapler except that it has a coil spring connecting the staple follower to the driver member and the latch is a pin, movable in a slot in the driver member, the pin becoming latched in undercut in the magazine member, but released by longitudinal movement of the pin away from the pivot against spring tension. In this invention, when adapted to the "Swingline" construction, the staple follower also is provided with integral upstanding lug means which engages the movable pin latch to release it forwardly when the staple follower nears the end of its path, thereby releasing the driver member from the magazine member.

In any stapler structure, a window may be provided in the upper forward portion of the driver member to reveal the staples in the magazine therebelow and visually indicate exhaustion from above, rather than from the side as in the prior art.

BRIEF DESCRIPTION OF THE DRAWINGS

FIG. 1 is a side elevation of one type of stapler closed;

FIG. 2 is a side elevation thereof in open position; and

FIG. 3 is a plan view thereof, on an enlarged scale, with the driver member open and broken away all showing one form of the invention;

FIG. 4 is an enlarged, perspective, detail, view showing the staple follower of the invention;

FIG. 5 is a top plan view thereof showing the window in the upper forward portion of the driver member;

Figure 6:
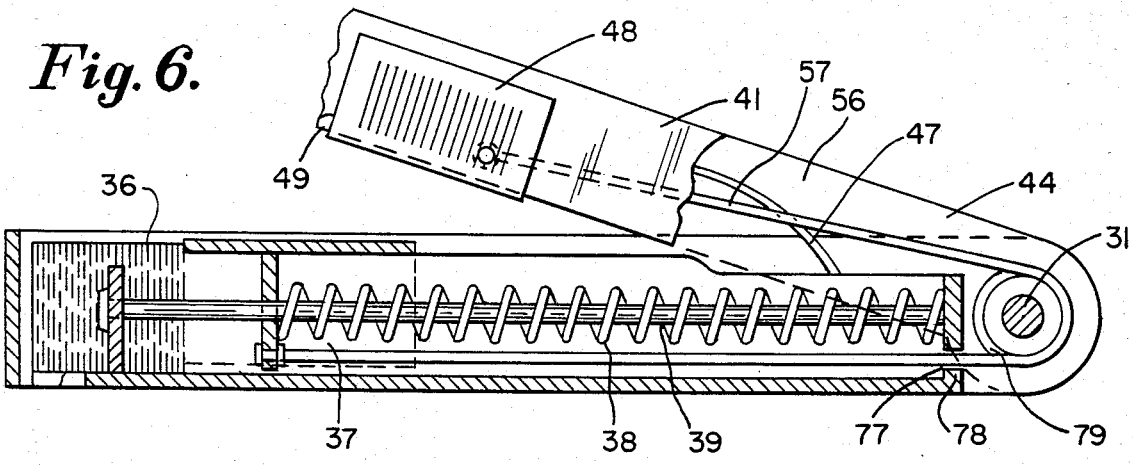
FIG. 6 is a diagrammatic side elevation of a stapler with a flexible strand connecting the staple follower to the latch.

As shown in the drawings, 20 is a stapler of a well known type such as a "Bostitch", having an elongated anvil member 21, forming a base 22 to maintain the stapler in upright position, an anvil 23 in the forward portion 24 for bending in the ends of staples, and having a pair of laterally spaced upstanding walls 25 and 26 in the rearward portion 27.

Stapler 20 includes an elongated staple magazine member 28 having a rearward portion 29, pivotally mounted on a pin 31 between the walls 25 and 26 of the anvil member 21, and having a forward portion 32 wih a staple guideway 33 leading to the anvil 23. The intermediate portion 34 of member 28 is a magazine 35 for staples 36 pushed by staple follower 37 in turn pushed by coil spring 38 captive on rod 39.

Stapler 20 also includes an elongated driver member 41, in the form of a cover overlying the magazine member 28 and having depending side walls 42 and 43. The rearward portion 44 thereof being pivoted outside walls 25 and 26 on pivot pin 31. Member 41 includes a driver 45, in the forward portion 46 thereof for driving each successive, individual staple 36 down guidway 33 onto anvil 23 all in a well known manner. Driver member 41 also includes a leaf spring 47 which rides on side walls 25 and 26 and spring biases the driver member upwardly away from the magazine member 28 as shown in FIG. 2.

In this invention, the driver member includes a latch 48, of U shaped cross section which is slidably mounted on depending side wall 43 of driver member 41 to move longitudinally thereof, and the magazine member 28 includes a side wise projecting detent 49 in rear of the latch, both being well forward toward the free ends of their respective members, as shown. Thus, instead of the conventional rearward latch location and rearward sliding release of the latch, in this invention the latch is moved forward and released by forward movement. As best shown in FIG. 4, the staple follower 37 is provided with an integral leg extension 51 having an integral upstanding lug 52 which engages the rear inside edge 50 of the latch 48, to move it forwardly and release the latch to cause the driver member 41 to spring up to the position shown in FIG. 2, when the staple follower is near the end of its path in the magazine 35.

As shown in FIG. 5, I prefer to also provide a window 53 in the pad 54 of the handle 55, of the driver member 41, so that the exhaustion of staples is visible from above to the user.

In FIG. 6, the driver member 56 is provided with a conventional latch 48 which releases by rearward movement toward pivot pin 31, and a flexible strand 57 extends from the staple follower 37 rearwardly through a hole 77 in back plate 78, then in a groove 79 around pivot pin 31, and then back to the latch 48. Thus, when the follower 37 nears the end of its path it exerts a rearward pull on latch 48 to release it from detent 49, spring open the driver member 41 and visually indicate exhaustion of staples. The strand 57 lies sinusously under coil spring 38 and rod 39 when slack, with staples fully loaded.

Figure 7:
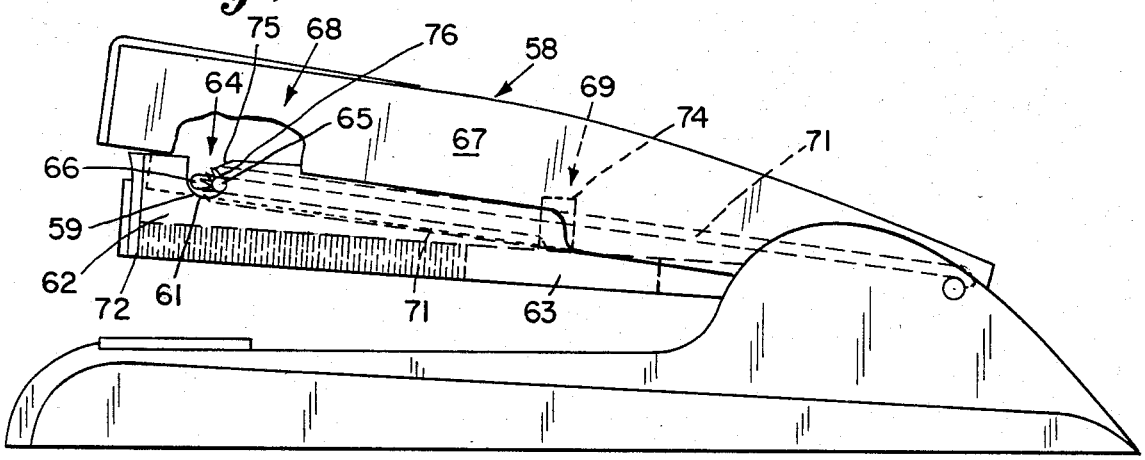
FIG. 7 is a side elevation of another type of stapler in closed condition, but broken away, to show the latch detent and staple follower.

A stapler 58 of the "Swingline" type is shown in FIG. 7, the parts being similar to those in the previous view except that the detents, such as 59, are undercut in the recesses such as 61 in the side walls such as 62 of the staple magazine member 63, and the latch means 64 is a pin 65 longitudinally slidable in slots such as 66 in the side walls, such as 67 of the driver member 68.

Figure 8:
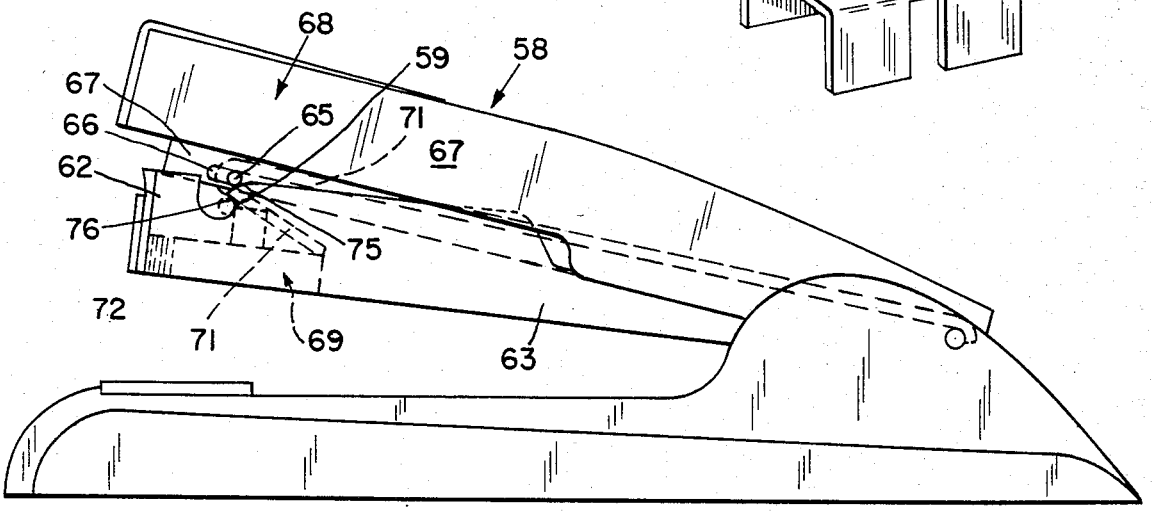
FIG. 8 is a view similar to FIG. 7 showing the stapler in partly open position, signalling that it is empty.

In this type of stapler, the staple follower 69 is connected by coil spring 71 to the pin 65, so that the pin 65 is normally urged rearwardly under detents 59, while the spring 71 also urges the staple follower 69 forwardly toward the guideway 72. This structure is illustrated in FIG. 8 wherein the driver member is shown held midway between open and closed position to illustrate the parts.

Figure 9:
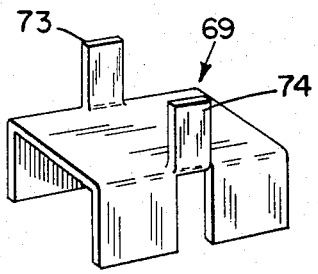
FIG. 9 is a detail, side perspective view of the staple follower used in the stapler of FIGS. 7 and 8.

As best shown in FIG. 9, the staple follower 69 is provided with a pair of upstanding lugs 73 and 74 which engage the pin 65 as the follower nears the end of its path toward the guideway 72, the lugs unseating the pin 65 from under the detents 59 to release the driver member 68 from the magazine member 63 thereby indicating diminshed supply of staples.

The release of the pin 65 causes the driver member 68 to pivot upwardly at a slight angle due to the spring 71 pulling the pin 65 upwardly and rearwardly along the inclined cam way 75 above the undercut 76, of the detents 59.

I claim:

1. In a stapler having an elongated anvil member, an elongated staple magazine member, and an elongated driver member, all pivoted to each other at one end thereof, the staple magazine member having a longitudinally movable staple follower spring urged away from said pivot and said magazine and driver members having cooperable, longitudinally movable latch means, releasably connecting them together, the combination of:

means connecting said longitudinally movable staple follower to said longitudinally movable latch means for releasing said latch means when said staple follower nears the end of its path, thereby releasing said driver member from said magazine member.

2. A stapler as specified in claim 1 wherein:

said latch means includes a latch slidably mounted on said driver member and a detent on said magazine member, said latch normally held under said detent, but releasable therefrom by movement away from said pivot;

and said staple follower is elongated, with an upstanding lug at the rear thereof adapted to engage said latch to slide it forwardly, when said follower nears the end of its path.

3. A stapler as specified in claim 1 wherein:

said latch means includes a latch slidable mounted on said driver member and normally engaged under a projecting detent on said magazine member, but releasable therefrom by movement toward said pivot;

and a flexible strand extends from said staple follower around said pivot and thence back to said latch;

whereby further advance of said staple follower, at the end of its path, pulls said latch toward said pivot to release said driver member.

4. A stapler for delivering staples into sheets, thereby attaching said sheets together, said stapler comprising:

an elongated anvil member forming a base for maintaining said stapler in upright position;

a staple magazine member having one end pivoted to one end of said anvil member and having a staple guideway at the other end;

a staple follower slidably mounted in said magazine member and spring urged away from said pivot end toward said guideway; and a driver member overlying, and pivotally mounted at one end to said one end of said magazine member;

a detent on said magazine member, and a latch slidably mounted on said driver member, said latch normally engaged under said detent, but slidably releaseable therefrom;

and mechanical means operably connecting said staple follower to said latch for slidably releasing said latch from said detent when said staple follower nearly reaches said guideway.

5. A stapler as specified in claim 4 wherein:

said mechanical means includes an elongated integral extension on one side of said staple follower terminating in an upstanding lug;

and said latch and detent are arranged to release by movement in the direction of said guideway.

6. A stapler as specified in claim 4 wherein:

said mechanical means includes a flexible strand extending from said staple follower toward and around said pivot and back to an attachment on said slidably movable latch; and said latch and detent are arranged to release by movement of said latch toward said pivot.

7. A stapler as specified in claim 4 wherein:

said driver member is an elongated inverted U shaped channel, forming a cover for over said staple magazine member; and said cover includes a forward portion, proximate the guideway in said magazine member, containing an opening through which the staples in said magazine member are visible.

8. A stapler of the type having:

an elongated anvil member with a forward portion having an anvil for bending staples inwardly and a rearward portion having a pair of upstanding, spaced apart side walls;

an elongated staple magazine member having a rearward portion pivotally mounted between the said walls of said base, having a forward portion forming a staple guideway to said anvil, a staple magazine in the form of an elongated channel, a staple follower and a spring for urging said follower and staples toward said guideway;

an elongated driver member having a rearward portion pivotally mounted outside the walls of said side walls, a forward portion with a driver adapted to enter said guideway to drive a staple onto said anvil, and a spring normally urging said cover upwardly away from said magazine;

said stapler characterized by said magazine member having a sidewise projecting detent, said driver member having a latch slidably mounted thereon and having a projecting portion caught under said detent, but releasable therefrom by sliding forwardly toward said guideway and said staple follower being connected to said latch so that when said follower reaches nearly the end of its path in said magazine member, it pulls said latch to release said driver member to spring upwardly.

* * * * *